United States Patent [19]

Elms

[11] 3,949,211

[45] Apr. 6, 1976

[54] LUMINAIRE HAVING BALLAST CIRCUITRY IN PHOTOCONTROL HOUSING

[75] Inventor: Robert T. Elms, Monroeville, Pa.

[73] Assignee: Westinghouse Electric Corporation, Pittsburgh, Pa.

[22] Filed: June 21, 1974

[21] Appl. No.: 481,931

[52] U.S. Cl. ..... 240/25; 240/11.4 R; 250/239

[51] Int. Cl.[2] ..... F21S 1/10

[58] Field of Search ..... 240/25, 3, 11.4 R, 47, 240/DIG. 6, DIG. 3; 250/239

[56] References Cited

UNITED STATES PATENTS

| | | | |
|---|---|---|---|
| 3,048,833 | 8/1962 | Bernheim | 240/25 X |
| 3,222,572 | 12/1965 | Powell, Jr. | 250/205 X |
| 3,486,070 | 12/1969 | Engel | 315/209 R |
| 3,590,316 | 6/1971 | Engel et al. | 315/209 R |
| 3,621,337 | 11/1971 | Kappenhagen | 250/239 X |

*Primary Examiner*—Robert P. Greiner
*Attorney, Agent, or Firm*—W. D. Palmer

[57] ABSTRACT

Outdoor lighting fixture utilizes lamp ballast which includes both solid-state control circuitry and a relatively massive inductor ballast. The solid-state control circuitry is mounted in a separate housing, such as the photocontrol housing, which is affixed to the exterior of the fixture by means of a plug-type receptacle, and the relatively massive inductor portion of the ballast is contained within the fixture body. Those portions of the solid-state control circuitry which require cooling use the separate housing as a heat sink. If troubles are encountered in the solid-state circuitry, the entire circuit can be replaced simply by plugging in a new unit.

3 Claims, 2 Drawing Figures

LUMINAIRE HAVING BALLAST CIRCUITRY IN PHOTOCONTROL HOUSING

BACKGROUND OF THE INVENTION

This invention relates to outdoor lighting fixtures or luminaires which utilize solid-state circuitry in their ballasts and, more particularly, to an improved mounting arrangement for a solid-state luminaire ballast which enables the solid-state portion of the ballast to be easily replaced.

The use of high-pressure mercury-vapor discharge lamps has greatly expanded in the past decade or so. Other types of high-intensity discharge lamps have also come into widespread use and examples of these other lamp types are the so-called high-pressure mercury-metal halide lamps and high-pressure sodium-mercury lamps. All of these discharge devices are generically known in the art as high intensity discharge (HID) light sources or lamps. All of these HID lamps are similar in that they require some sort of current limiting device to provide a ballasting therefor since the arcs all operate with what is known as a negative volt-ampere characteristic. In other words, the arc is of such nature that the higher the current, the lower the electrical resistance offered, with the result that without a current limiting device of some sort in series with the lamp, it would rapidly self destruct. In addition, the starting voltage required normally substantially exceeds the operating voltage. Because of these requirements, many different so-called solid-state circuits have been devised for operating such HID lamps.

Some solid-state ballast circuits use no inductor ballasting whatsoever. Some of the more promising solid-state circuits for operating HID lamps, however, utilize a combination of solid-state control circuitry and an inductor ballast or current limiting device. Since the original ballasts for HID lamps were inductors, the newer types of ballasts which combine the inductor with the solid-state circuitry can be termed hybrids, i.e., they combine both solid-state circuitry and inductors. These hybrid ballasts have shown a high degree of promise as far as competing both commercially and performance-wise with the prior inductor-ballast circuits.

A typical hybrid type circuit for an HID lamp is disclosed in U.S. Pat. No. 3,590,316 dated June 29, 1971 wherein the inductor portion of the ballast is designated as L2 in FIG. 2A of the patent and the solid-state circuitry controls the wattage of the lamp so that it is always the same, even though the voltage drop across the lamp may vary. A starting circuit which can be used to initially start any of a plurality of different types of lamps, as used in the previous circuit, is described in U.S. Pat. No. 3,519,881, dated July 7, 1970. Another hybrid-type ballast circuit is shown in U.S. Pat. No. 3,486,070 dated Dec. 23, 1969, wherein the inductor ballast portion of the circuit is designated 14 in FIG. 1, and the described solid-state circuitry is used to control the power which the lamp consumes. Another different circuit is disclosed in U.S. Pat. No. 3,222,572, dated Dec. 7, 1965.

In all of these hybrid circuits, the lamps are normally designed to consume a substantial amount of power, with a representative lamp rating being 400 watts. This has necessitated a relatively massive inductor ballast, which is normally located within the housing of the light fixture or so-called luminaire. The solid-state control circuitry, however, can be made to be very compact and most of this circuitry can even be placed upon a small chip. Some of the solid-state elements, however, normally require some sort of heat sink. Because of its size and ruggedness, the inductor portion of the lamp ballast is normally not susceptible to failure. If failures in the hybrid ballast do occur, they are most apt to occur in the relatively fragile and relatively complicated solid-state circuitry.

A solid-state photocontrol device with a heat-dissipating housing is disclosed in U.S. Pat. No. 3,621,337 dated Nov. 16, 1971.

SUMMARY OF THE INVENTION

There is provided a combination outdoor lighting fixture for an HID lamp which uses a current limiting ballast including both solid-state control circuitry and relatively massive inductor means. The inductor is affixed within the fixture body. Such a fixture also is usually provided with a photocontrol device contained in a separate housing which is affixed to the exterior surface of the fixture body, in order to control the application of energizing potential in accordance with ambient light conditions. Such photocontrol housings are normally affixed to the fixture body by a simple plug-type electrical connector. In accordance with the present invention, the solid-state circuitry control portion of the ballast is placed within a separate housing, such as the photocontrol housing, and is operationally electrically connected to the inductor and the lamp by means of a plug-type connector. That portion of the solid-state circuitry which is subject to excessive heating during operation thereof is affixed in heat-transfer relationship with the heat-conducting housing, which keeps these solid-state components quite cool. With such a construction, if operational difficulties are encountered with the solid-state control circuitry, it is a simple matter merely to plug in a new unit.

BRIEF DESCRIPTION OF THE DRAWINGS

For a better understanding of the invention, reference may be had to the preferred embodiment, exemplary of the invention, shown in the accompanying drawings in which.

DESCRIPTION OF THE PREFERRED EMBODIMENT

Figure 1:
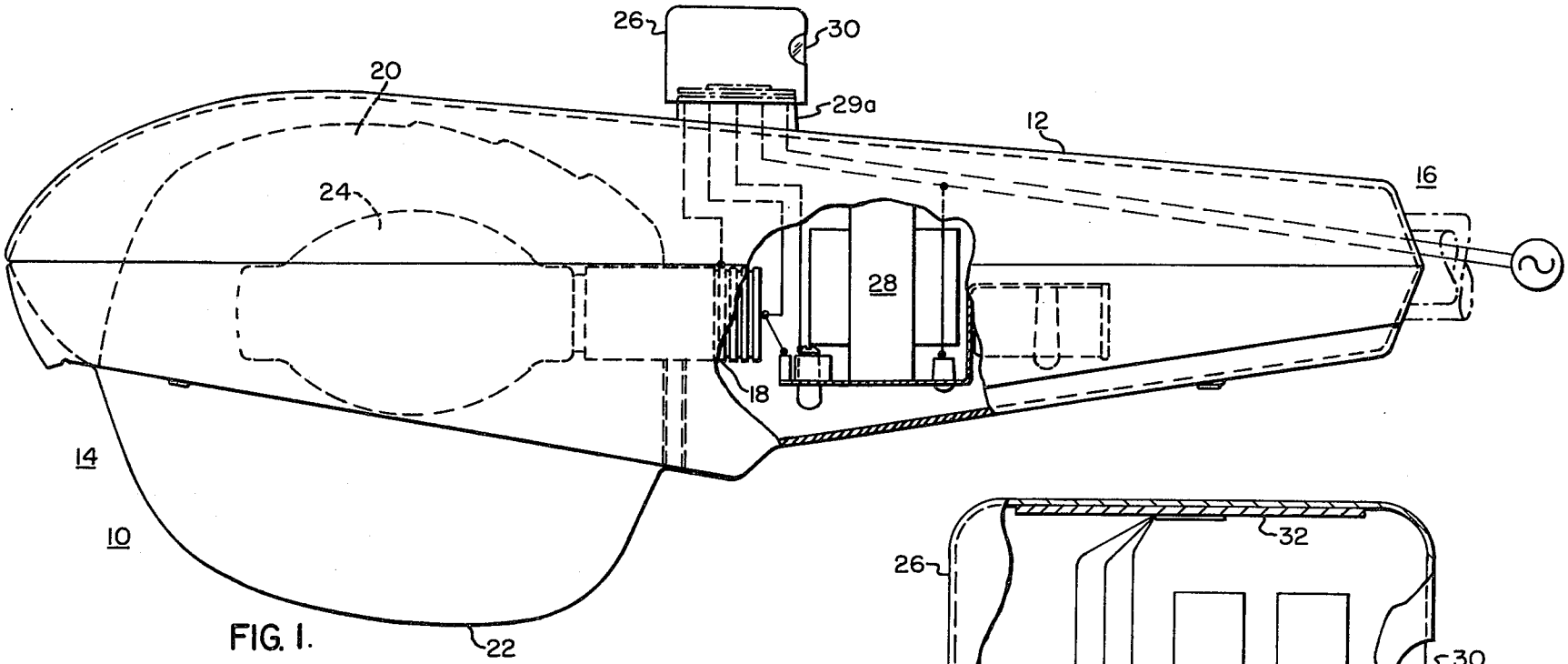
FIG. 1 is an elevational view, shown partly in section, illustrating a conventional street lighting fixture which incorporates modified ballast circuitry with the solid-state portion thereof mounted in the photocontrol housing.

With reference to the form of the invention as shown in the drawings, the luminaire 10 as shown in FIG. 1 generally comprises a fixture body 12 having an optical system 14 proximate one end thereof and a luminaire mounting arrangement 16 proximate the other end. The optical system conventionally comprises a lamp socket 18, lamp reflector 20, a light-distributing refractor 22, and the lamp 24, which as an example is a conventional high-pressure mercury-vapor lamp. The photocontrol, which will be described in more detail hereinafter, is mounted in a waterproof metallic housing 26 which also contains the solid-state ballast circuitry.

Electrical connection for the luminaire 10 is made through the mounting portion 16 thereof and connects both to the inductor ballast means 28, the lamp 24 and the solid-state control circuitry as well as the photocell, both of which are contained in the housing 26. As a specific example, the circuit as shown in FIGS. 2A and 2B of U.S. Pat. No. 3,590,316 is incorporated into the luminaire 10, with the inductor ballast means 28 corresponding to the inductor L2 shown in FIG. 2A of this patent, and with the solid-state circuitry mounted on circuit boards within the photocontrol housing 26.

Figure 2:
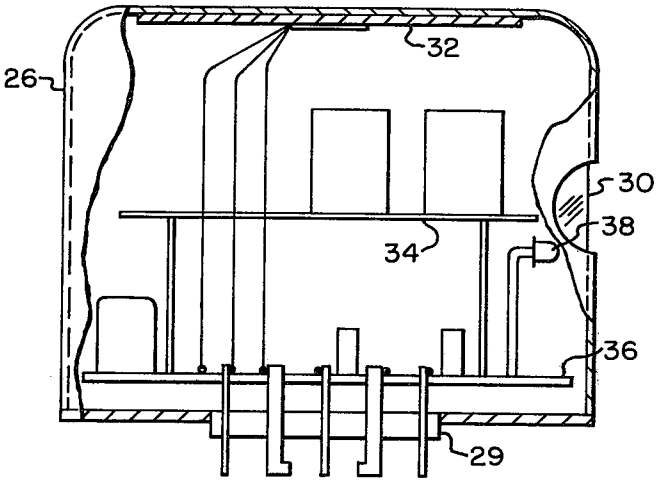
FIG. 2 is an enlarged elevational view, shown partly in section, illustrating the modified photocontrol housing which incorporates the solid-state ballast circuitry.

The modified photocontrol and solid-state ballast is shown in expanded view in FIG. 2, with the housing 26 broken away to show the elements contained therein. Electrical connection is made by a five-terminal plug 29 which fits into a mating female member 29*a* located at the top portion of the fixture body 12. Two of the plug terminals connect to the line, two connect to the lamp and the remaining plug terminal connects to the other side of inductor L2, see the detailed circuit diagram of U.S. Pat. No. 3,590,316.

A clear plastic window 30 is provided in the photocontrol housing 26 and the solid-state AC power switch 32, which is designated S in FIG. 2A of U.S. Pat. No. 3,590,316, is mounted at the top of the photocontrol housing 26, so that this heat-conducting metallic housing will serve as a heat sink. An upper circuit board 34, which is adapted to hold the bulkier components such as the transformers designated T1 and T2 in said FIG. 2A of U.S. Pat. No. 3,590,316, supplements the lower circuit board 36 and the photosensitive element or photocell 38 is positioned proximate the clear plastic window 30. The remainder of the solid-state elements are mounted on the lower circuit board 36 which can be formed as a chip if desired, in accordance with conventional practices.

The location of the photocontrol housing 26 and the thermal insulation afforded by the plug connector therefor both serve to protect the solid-state elements from the heat generated by the lamp 24, thereby to minimize maintenance troubles. If troubles do occur in the solid-state control circuit, however, it is a simple matter merely to unplug one housing unit 26 and insert another in place thereof.

As a possible alternative embodiment, the photocontrol housing 26 need not project above the outline of the luminaire 10, but could be recessed therein so that the visual appearance of the luminaire would be unbroken by any projections. In such an embodiment, the plastic window 30 would normally be located proximate the upper surface of the housing 26.

As another possible alternative embodiment, in copending application Ser. No. 470,102, filed May 15, 1974, and owned by the present assignee, is disclosed an add-on device for a high-intensity discharge lamp and inductor ballast which reduces the wattage at which the lamp is operated. The add-on device is of solid-state design and has two parallel circuit paths, one of which is an RC circuit and the other of which comprises a triac. A diac connects the gate of the triac to the midpoint of the RC circuit to control the time in each half cycle of energizing potential that the triac fires. Such a ballasting circuit can be incorporated into the photocontrol housing 26 in accordance with the present invention. Alternatively, such a circuit can be incorporated into a similar exterior plug-type housing without the photocontrol. Such a lamp-dimming circuit is readily installed or removed.

I claim:

1. In combination with an outdoor lighting fixture for a high-intensity discharge lamp, said fixture having a fixture body adapted to receive and retain a discharge lamp, a current limiting ballast means required for operation of said discharge lamp, said ballast means affixed to said fixture and operable to connect said lamp to the energizing potential therefor, said ballast means including as an operative part thereof solid-state control circuitry, a portion of which tends to heat excessively during operation and also including relatively massive inductor means, said inductor means affixed within said fixture body, a photocontrol means affixed to the exterior surface of said fixture body to control the application of energizing potential to said lamp in accordance with predetermined ambient light conditions, said photocontrol means enclosed in a heat-conducting waterproof housing which is affixed to said fixture body by electrical connector means comprising a plug member extending from said housing and a mating female member affixed to the exterior surface of said fixture body, the improvement which comprises:

a. the solid-state control circuitry portion of said ballast means retained within said photocontrol means housing separate from said fixture body and operationally electrically connected to said inductor means and said lamp by said electrical connector means; and b. that portion of said solid-state circuitry which is subject to excessive heating during operation thereof being affixed in heat-transfer relationship with said heat-conducting housing to remain relatively cool during operation thereof; whereby operational difficulties encountered with said solid-state control circuitry are readily corrected simply by plugging in a new unit.

2. The combination as specified in claim 1, wherein said solid-state control circuitry which is not subject to excessive heating during operation thereof is mounted on a circuit board which is retained in said photocontrol housing.

3. In combination with an outdoor lighting fixture for a high-intensity discharge lamp, said fixture having a fixture body adapted to receive and retain a discharge lamp, a current limiting ballast means required for operation of said discharge lamp, said ballast means affixed to said fixture and operable to connect said lamp to the energizing potential therefor, said ballast means including as an operative part thereof solid-state control circuitry, a portion of which tends to heat excessively during operation and also including relatively massive inductor means, said inductor means affixed within said fixture body, a heat-conducting waterproof housing which is affixed to said fixture body by electrical connector means comprising a plug member extending from said housing and a mating female member affixed to the exterior surface of said fixture body, the improvement which comprises:

a. the solid-state control circuitry portion of said ballast means retained within said housing separate from said fixture body and operationally electrically connected to said inductor means and said lamp by said electrical connector means; and b. that portion of said solid-state circuitry which is subject to excessive heating during operation thereof being affixed in heat-transfer relationship with said heat-conducting housing to remain relatively cool during operation thereof; whereby operational difficulties encountered with said solid-state control circuitry are readily corrected simply by plugging in a new unit.

* * * * *